US005401606A

United States Patent [19]

Reardon et al.

[11] Patent Number: 5,401,606

[45] **Date of Patent: * Mar. 28, 1995**

[54] LASER-INDUCED MELT TRANSFER PROCESS

[75] Inventors: Joseph E. Reardon, Wilmington, Del.; Anthony J. Serino, Kennett Square, Pa.

[73] Assignee: E. I. Du Pont de Nemours and Company, Wilmington, Del.

[ * ] Notice: The portion of the term of this patent subsequent to Mar. 7, 2012 has been disclaimed.

[21] Appl. No.: 103,302

[22] Filed: Apr. 30, 1993

[51] Int. Cl.[6] ..... G03C 5/54

[52] U.S. Cl. ..... 430/200; 430/254; 430/952; 430/964

[58] Field of Search ..... 430/200, 254, 964, 952

[56] References Cited

U.S. PATENT DOCUMENTS

| | | | |
|---|---|---|---|
| 3,129,661 | 4/1964 | Newman | 430/200 |
| 3,833,441 | 9/1974 | Heiart | 430/200 |
| 3,962,513 | 6/1976 | Eames | 428/323 |
| 3,964,389 | 6/1976 | Peterson | 101/467 |
| 3,975,563 | 8/1976 | Franer et al. | 430/200 |
| 4,245,003 | 1/1981 | Oransky et al. | 428/323 |
| 4,626,493 | 12/1986 | Butters et al. | 430/201 |
| 4,914,078 | 4/1990 | Hann et al. | 503/227 |
| 5,064,743 | 11/1991 | Koshizuka et al. | 430/253 |
| 5,089,372 | 2/1992 | Kirihata et al. | 430/200 |
| 5,232,817 | 8/1993 | Kawakami et al. | 430/200 |
| 5,238,778 | 8/1993 | Hirai et al. | 430/200 |

FOREIGN PATENT DOCUMENTS

| | | | |
|---|---|---|---|
| 0530018A1 | 3/1993 | European Pat. Off. | B41M 5/40 |
| 0531580A1 | 3/1993 | European Pat. Off. | B41M 5/38 |
| 61-1041547 | 2/1986 | Japan | B41C 1/10 |

*Primary Examiner*—Richard L. Schilling

[57] ABSTRACT

A laser-induced melt transfer process is described in which a melt viscosity modifier is used to facilitate the melt transfer process.

3 Claims, 2 Drawing Sheets

LASER-INDUCED MELT TRANSFER PROCESS

FIELD OF THE INVENTION

This invention relates to a thermal transfer process and, in particular, to a laser-induced melt transfer process.

BACKGROUND OF THE INVENTION

Laser-induced thermal transfer processes are well-known in applications such as color proofing and lithography. Such laser-induced processes include, for example, dye sublimation, dye transfer, ablative material transfer, and melt transfer of fusible materials such as waxes. Such processes are described in, for example, Baldock, UK Patent 2,083,726; DeBoer, U.S. Pat. No. 4,942,141; Kellogg, U.S. Pat. No. 5,019,549; Evans, U.S. Pat. No. 4,948,776; Foley et al., U.S. Pat. No. 5,156,938; Ellis et al., U.S. Pat. No. 5,171,650; and Koshizuka et al., U.S. Pat. No. 4,643,917. The processes use a laserable assemblage comprising a donor element that contains the imageable component, i.e., the material to be transferred, and a receiver element. The donor element is imagewise exposed by a laser, usually an infrared laser, resulting in transfer of material to the receiver element. The exposure takes place only in a small, selected region of the donor at one time, so that the transfer can be built up one pixel at a time. Computer control produces transfer with high resolution and at high speed.

For the preparation of images for proofing applications, the imageable component is a colorant. For the preparation of lithographic printing plates, the imageable component is an oleophilic material which will receive and transfer ink in printing. In general, when an infrared laser is used, a separate infrared radiation absorber is also included.

While all of the above processes have been used, they each suffer from certain disadvantages. Dyes used in dye sublimation and dye transfer processes are frequently unstable over long periods of time. It is also difficult to obtain colored images of sufficient density. In addition, the range of colors available is limited. Ablative transfer processes often require high laser power densities in order to transfer sufficient amounts of the imageable component. While sufficient transfer density can be obtained using melt transfer of fusible materials, it is frequently undesirable to have waxes in the final image. It is also difficult to obtain the necessary resolution with these systems.

SUMMARY OF THE INVENTION

This invention provides a laser-induced melt transfer process which comprises:

a) imagewise exposing to laser radiation a laserable assemblage comprising 1) a donor element comprising a support having at least one layer and bearing on a first surface thereof (i) at least one imageable component and (ii) at least one melt viscosity modifier, wherein (i) and (ii) can be in the same or different layers, and 2) a receiver element situated proximally to the first surface of the donor element, wherein a substantial portion of (i) and (ii) is transferred to the receiver element;

b) separating the donor element from the receiver element.

In a second embodiment this invention concerns a laser-induced melt transfer method for making a color image which comprises:

a) imagewise exposing to laser radiation a laserable assemblage comprising 1) a donor element comprising a support having at least one layer and bearing on a first surface thereof (i) at least one colorant and (ii) at least one melt viscosity modifier, wherein (i) and (ii) can be in the same or different layers, and 2) a receiver element situated proximally to the first surface of the donor element, wherein a substantial portion of (i) and (ii) is transferred to the receiver element;

b) separating the donor element from the receiver element, steps (a)-(b) being repeated at least once using the same receptor and a different donor element having a colorant the same as or different from the first colorant.

In a third embodiment this invention concerns a laser-induced melt transfer method for making a lithographic printing plate which comprises:

1) a donor element having at least one layer and bearing on a first surface thereof (i) at least one oleophilic resin, and (ii) at least one melt viscosity modifier, wherein (i) and (ii) can be in the same or different layers, and 2) a receiver element situated proximally to the first surface of the donor element, wherein a substantial portion of (i) and (ii) is transferred to the receiver element;

b) separating the donor element from the receiver element.

DETAILED DESCRIPTION OF THE INVENTION

Figure 1A:
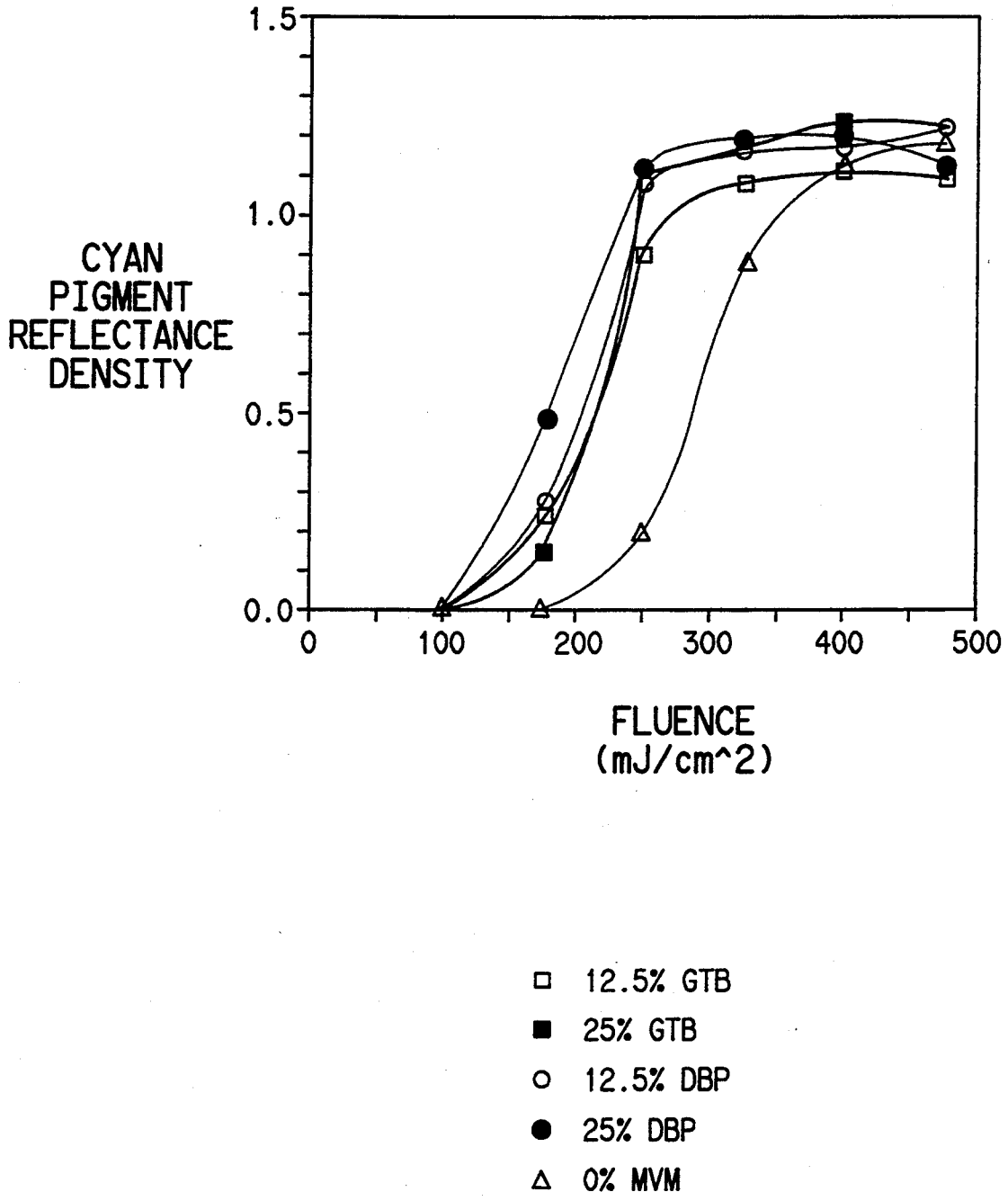
FIG. 1A is a plot of transfer density against laser fluence, for a low coating weight.

This invention is a laser-induced melt transfer process which provides good density transfer of the imageable component onto the receiver element.

Process Steps

1. Exposure

The first step in the process of the invention is imagewise exposing a laserable assemblage to laser radiation. The laserable assemblage comprises 1) a donor element comprising a support having at least one layer and bearing on a first surface thereof (i) at least one imageable component and (ii) at least one melt viscosity modifier, wherein (i) and (ii) can be in the same or different layers, and 2) a receiver element situated proximally to the first surface of the donor element. The composition of the assemblage is discussed in detail below.

Various types of lasers can be used to expose the laserable assemblage. The laser is preferably one emitting in the infrared, near-infrared or visible region. Particularly advantageous are diode lasers emitting in the region of 750 to 870 nm which offer substantial advantage in terms of their small size, low cost, stability, reliability, ruggedness and ease of modulation. Diode lasers emitting in the range of 800 to 840 nm are most preferred. Such lasers are available from, for example, Spectra Diode Laboratories (San Jose, Calif.).

The exposure can take place through the support of the donor element or through the receiver element, provided that these, the donor support and the receiver element, are substantially transparent to the laser radiation. In most cases, the donor support will be a film which is transparent to the laser radiation and the exposure is conveniently carried out through the support. However, if the receiver element is substantially transparent to the laser radiation, the process of the invention can also be carried out by imagewise exposing the receiver element to laser radiation.

It is preferred that a vacuum be applied to the assemblage during the exposure step. The vacuum provides good contact between the donor and receiver elements, and thus facilitates transfer to the receiver element. The vacuum can be conveniently applied as a vacuum drawdown on the bed of the laser imaging apparatus.

The laserable assemblage is exposed imagewise so that material is transferred to the receiver element in a pattern. The pattern itself can be, for example, in the form of dots or linework generated by a computer, in a form obtained by scanning artwork to be copied, in the form of a digitized image taken from original artwork, or a combination of any of these forms which can be electronically combined on a computer prior to laser exposure. The laser beam and the laserable assemblage are in constant motion with respect of each other, such that each minute area of the assemblage ("pixel") is individually addressed by the laser. This is generally accomplished by mounting the laserable assemblage on a rotatable drum. A flat bed recorder can also be used.

2. Separation

The next step in the process of the invention is separating the donor element from the receiver element. Usually this is done by simply peeling the two elements apart. This generally requires very little peel force, and is accomplished by simply separating the donor support from the receiver element. This can be done using any conventional separation technique and can be manual or automatic (without operator intervention).

Laserable Assemblage

1. Donor Element

The donor element comprises a support having at least one layer and bearing on a first surface thereof (i) at least one imageable component and (ii) at least one melt viscosity modifier, wherein (i) and (ii) can be in the same or different layers.

Any dimensionally stable, sheet material can be used as the donor support. When the laserable assemblage is to be imaged through the donor support, the support should also be capable of transmitting the laser radiation, and not be adversely affected by this radiation. Examples of suitable materials include, for example, polyesters, such as polyethylene terephthalate and polyethylene naphthanate; polyamides; polycarbonates; fluoropolymers; polyacetals; polyolefins; etc. A preferred support material is polyethylene terephthalate film. The donor support typically has a thickness of about 2 to about 250 micrometers, (0.1 to 10 mils). A preferred thickness is about 50 to 175 micrometers, (2 to 7 mils). As those skilled in the art will appreciate, some commercially available films will also have subbing layers. These can be used as well.

The nature of the imageable component will depend on the intended application for the assemblage. For imaging applications, the imageable component will be a colorant. Useful colorants include dyes and pigments. Examples of suitable dyes include the Intratherm® dyes available from Crompton and Knowles (Reading, Pa.) and the dyes disclosed by Evans et al. in U.S. Pat. Nos. 5,155,088, 5,134,115, 5,132,276, and 5,081,101. Examples of suitable inorganic pigments include carbon black and graphite. Examples of suitable organic pigments include Heliogen® Blue L6930; Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C. I. No. Pigment Red 122); Indofast® Brilliant Scarlet R6300 (C.I. No. Pigment Red 123); Quindo Magenta RV 6803; Monastral® Blue G (C.I. No. Pigment Blue 15); Monastral® Blue BT 383D (C.I. No. Pigment Blue 15); Monastral® Blue G BT 284D (C.I. No. Pigment Blue 15); and Monastral® Green GT 751D (C.I. No. Pigment Green 7). Combinations of pigments and/or dyes can also be used.

In accordance with principles well known to those skilled in the art, the concentration of colorant will be chosen to achieve the optical density desired in the final image. The amount of colorant will depend on the thickness of the active layer and the absorption of the colorant.

A dispersant is usually present when a pigment is to be transferred, in order to achieve maximum color strength, transparency and gloss. The dispersant, generally an organic polymeric compound, is used to disperse the fine pigment particles and avoid flocculation and agglomeration. A wide range of dispersants is commercially available. A dispersant will be selected according to the characteristics of the pigment surface and other components in the composition as practiced by those skilled in the art. Conventional pigment dispersing techniques, such as ball milling, sand milling, etc., can be employed.

For lithographic applications, the imageable component is an oleophilic, ink-receptive material. The oleophilic material is usually a film-forming polymeric material. Examples of suitable oleophilic materials include polymers and copolymers of acrylates and methacrylates; polyolefins; polyurethanes; polyesters; polyaramids; epoxy resins; novolak resins; and combinations thereof. Preferred oleophilic materials are acrylic polymers.

In lithographic applications a colorant can also be present. The colorant facilitates inspection of the plate after it is made. Any of the colorants discussed above can be used. The colorant can be a heat-, light-, or acid-sensitive color former. The colorant can be in a layer that is the same as or different from the layer containing the oleophilic material.

The donor element further comprises at least one melt viscosity modifier (MVM). Surprisingly, it has been found that the addition of an MVM to the donor element dramatically improves the transfer process. For a given coating weight, the addition of an MVM results in a lowering of the laser fluence necessary to produce a given transfer density. Laser fluence is defined herein as energy per unit area at full width half max of a gaussian beam.

Figure 1B:
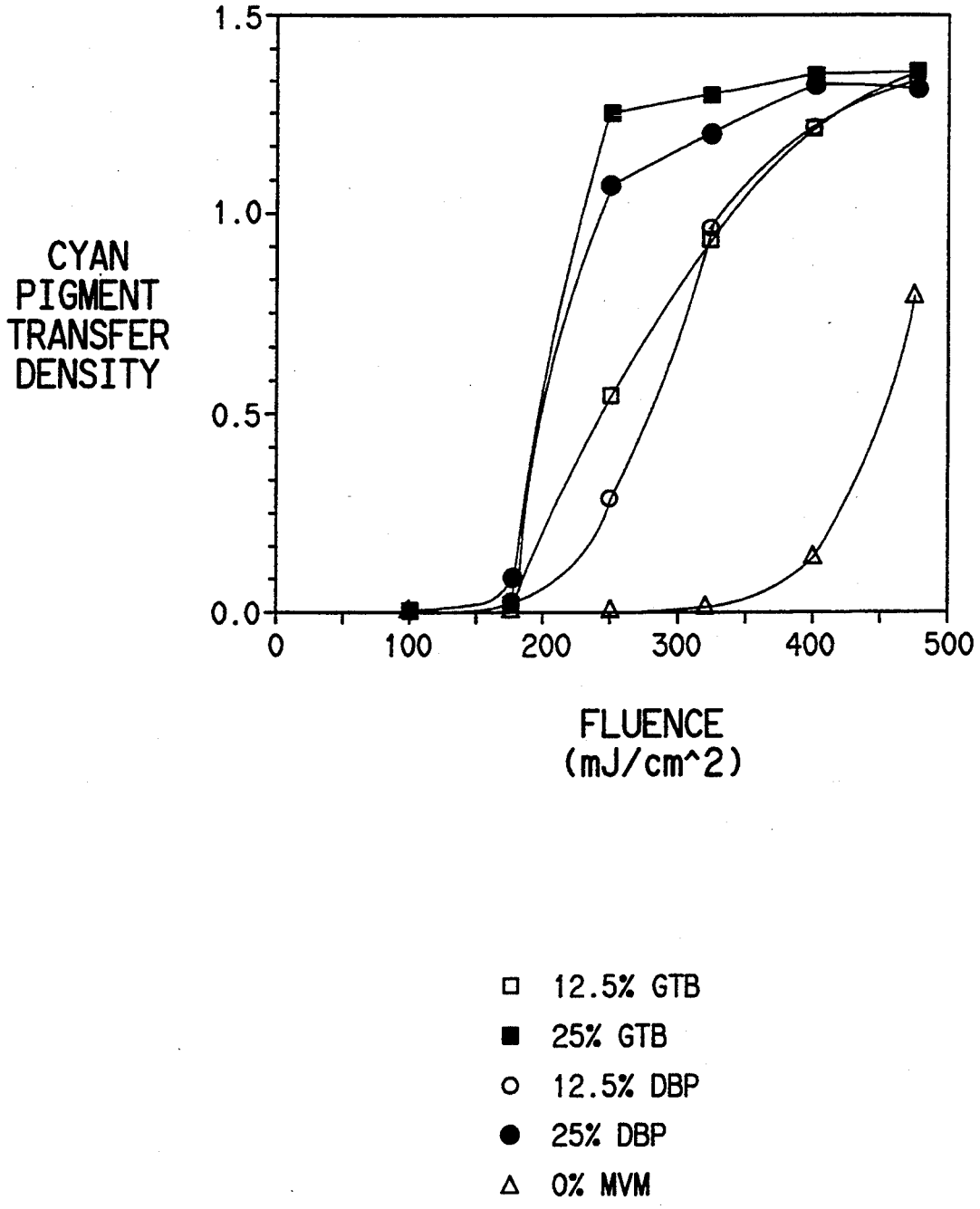
FIG. 1B is a plot of transfer density against laser fluence, for a high coating weight.

The beneficial effect of the MVM is clearly illustrated by FIG. 1. This figure contains a family of curves in which transferred density is plotted against the laser fluence used for different amounts of MVM. In FIG. 1A a low coating weight on the donor element is used. In FIG. 1B a high coating weight is used. When low coating weights are used, the curves all end at approximately the same transferred density. However, the addition of the MVM shifts the curve to lower fluences, meaning that lower laser power is necessary in order to transfer the imageable component to the same density. When high coating weights are used, the coating without an MVM results in a lower transferred density even at the highest fluence level. Thus, when an MVM is present lower laser fluence levels and higher donor coating weights can be used which results in much greater formulation latitude.

While not wishing to be bound by any theory, it is believed that the addition of the MVM may alter the mechanism by which the imageable component is transferred to the receiver element. The addition of the MVM, allows the imageable component to be transferred by what is believed to be a melt transfer mechanism. As implied by the term, the MVM lowers the softening point and the melt viscosity of the materials on the donor support, thus facilitating a melt transfer.

The MVM should be compatible with the other materials on the donor element and lower their softening point. Types of materials which can be used as the MVM include plasticizers, monomers and low molecular weight oligomers. Plasticizers are well known and numerous examples can be found in the art. These include, for example, acetate esters of glycerine; polyesters of phthalic, adipic and benzoic acids; ethoxylated alcohols and phenols; and the like. Monomers and low molecular weight oligomers can also be used as the MVM. These include mono- and polyfunctional epoxides and aziridines; mono- and polyesters of acrylic and methacrylic acids with alcohols; mono- and divinyl ethers. Mixtures can also be used. Dibutyl phthalate and glyceryl tribenzoate are preferred as the MVM.

When more than one material is to be transferred, these materials can be in a single layer on the support, or in different layers on the same side of the support. The concentration of the various materials on the support will be stated relative to the weight of all the layers on the support, i.e., the total coating weight. Depending upon the desired optical density, typical colorant concentrations are 5 to 75% by weight, based on the total coating weight, preferably 20 to 40% by weight. For optimum particle size, a dispersant is generally present in a 1:1 to 1:3 dispersant-to-pigment ratio. The amount of oleophilic material is generally about 20 to 60% by weight, based on the total coating weight, preferably 30 to 50% by weight. The MVM is generally present in an amount of about 15 to 55% by weight, based on the total coating weight, preferably 25 to 45% by weight.

In most cases it is desirable to have a laser-radiation absorbing component included in the donor element. The preferred lasers are those emitting in the infrared, near-infrared or visible regions. For those lasers, the laser-radiation absorbing component can comprise finely divided particles of metals such as aluminum, copper or zinc, one of the dark inorganic pigments, such as carbon black or graphite, or mixtures thereof. For infrared and near-infrared lasers, the laser-radiation absorbing component is preferably an infrared or near-IR absorbing dye, particularly for applications in which color images are formed. Suitable dyes which can be used alone or in combination include poly(substituted)phthalocyanine compounds and metal-containing phthalocyanine compounds; cyanine dyes; squarylium dyes; chalcogenopyryloarylidene dyes; croconium dyes; metal thiolate dyes; bis(chalcogenopyrylo)polymethine dyes; oxyindolizine dyes; bis(aminoaryl)polymethine dyes; merocyanine dyes; and quinoid dyes. Infrared-absorbing materials for laser-induced thermal imaging have been disclosed, for example, by: Barlow, U.S. Pat. No. 4,778,128; DeBoer, U.S. Pat. Nos. 4,942,141, 4,948,778, and 4,950,639; Kellogg, U.S. Pat. No. 5,019,549; Evans, U.S. Pat. Nos. 4,948,776 and 4,948,777; and Chapman, U.S. Pat. No. 4,952,552.

The laser-radiation absorbing component can be in the same layer as either the imageable component, or the MVM, or in a separate layer. When present, the component generally has a concentration of about 1 to 10% by weight, based on the total coating weight; preferably 2 to 5% by weight.

Other ingredients, for example, surfactants, coating aids and binders, can be present in any of the layers on the support, provided that they: (i) are compatible with the other ingredients, (ii) do not adversely affect the properties of the assemblage in the practice of the process of the invention, and, (iii) for color imaging applications, do not impart unwanted color to the image.

A polymeric binder can be used in addition to the imageable component and MVM. The binder should be of sufficiently high molecular weight that it is film forming, yet of sufficiently low molecular weight that it is soluble in the coating solvent. A surfactant can be present to improve the wetting and flow characteristics of the composition.

The compositions for the layer or layers to be coated onto the donor support can each be applied as a dispersion in a suitable solvent, however, it is preferred to coat them from a solution. Any suitable solvent can be used as a coating solvent, as long as it does not deleteriously affect the properties of the assemblage, using conventional coating techniques or printing techniques, for example, gravure printing.

2. Receiver Element

The receiver element typically comprises a receptor support and, optionally, an image-receiving layer. The receptor support comprises a dimensionally stable sheet material. As noted above, the assemblage can be imaged through the receptor support if that support is transparent. Examples of transparent films include, for example polyethylene terephthalate, polyether sulfone, a polyimide, a poly(vinyl alcohol-co-acetal), or a cellulose ester, such as cellulose acetate. Examples of opaque supports materials include, for example, polyethylene terephthalate filled with a white pigment such as titanium dioxide, various paper substrates, or synthetic paper, such as Tyvek® spunbonded polyolefin. For lithographic printing applications, the support is typically a thin sheet of aluminum, such as anodized aluminum, or polyester.

Although the imageable component can be transferred directly to the receptor support, the receiver element typically has an additional receiving layer on one surface thereof. For image formation applications, the receiving layer can be a coating of, for example, a polycarbonate, a polyurethane, a polyester, polvinyl chloride, styrene/acrylonitrile copolymer, poly(caprolactone), and mixtures thereof. This image receiving layer can be present in any amount effective for the intended purpose. In general, good results have been obtained at coating weights of 1 to 5 g/m$^2$. For lithographic applications, typically the aluminum sheet is treated to form a layer of anodized aluminum on the surface as a receptor layer. Such treatments are well known in the lithographic art.

It is also possible that the receiver element not be the final intended support for the imageable component. The receiver element can be an intermediate element and the laser imaging step can be followed by one or more transfer steps by which the imageable component is transferred to the final support. This is most likely to be the case for multicolor proofing applications in which the multicolor image is built up on the receiver element and then transferred to the permanent paper support. The following examples are intended to illustrate the practice of the invention and should not be construed as a limitation thereon.

EXAMPLES
GLOSSARY:

| | |
|---|---|
| BGE | butyl glycidyl ether |
| CHVE | 1,4-bis[(vinyloxy)methyl]cyclohexane |
| CY 179 | cycloaliphatic liquid epoxy resin; Araldite ® CY 179 from Ciba-Geigy |
| Cyan | Heliogen ® blue pigment L6930; added as a 20/10/70 dispersion of pigment/RCH-87763 dispersant/solvent (MEK or NBA) |
| DBP | dibutyl phthalate |
| DEH 82 | epoxy during agent: 65–69% bisphenol A epoxy resin; 24–29% bisphenol A; 3.5% 2-methylimidazole; 2.5% polyacrylate flow modifier; from Dow Chemical Co., Midland, MI |
| DER 6225 | medium molecular weight bisphenol A-based epoxy resin, melt viscosity (150° C.) 800–1600 cs; from Dow Chemical Co., Midland, MI |
| DER 642U | high molecular weight novolac modified epoxy resin, melt viscosity (150° C.) 2000–4000 cs; from Dow Chemical Co., Midland, MI |
| DER 661 | low molecular weight bisphenol A-based epoxy, melt viscosity (150° C.) 400–800 cs; from Dow Chemical Co., Midland. MI |
| DER 665U | high molecular weight bisphenol A-based epoxy resin, melt viscosity (150° C.) 10,000–30,000 cs; from Dow Chemical Co., Midland, MI |
| DER 668 | high molecular weight bisphenol A-based epoxy resin, Gardner viscosity at 40% non-volatile in Dowanole ® DB glycol ether Z-Z4; from DOW Chemical Co., Midland, MI |
| DVE | triethylene glycol divinyl ether |
| E2010 | medium molecular weight methacrylate polymer; Elvacitee ® 2010 from E.I. du Pont de Nemours and Company, Wilmington, DE |
| EPT2445 | low molecular weight polymethylmethacrylate, MK about 10,000 |
| EPT2519 | methacrylate terpolymer with 16 wt % glycidyl methacrylate |
| EPT2678 | methacrylate terpolymer with 7.5 wt % glycidyl methacrylate |
| GTB | glyceryl tribenzoate; Uniplex ® 260 from Unitex Chemical Corp. |
| HBVE | 4-(ethenyloxy)-1-butanol |
| MEK | methyl ethyl ketone |
| NBA | n-butyl acetate |
| PMMA | methyl methacrylate polymer |
| RCH 87763 | AB dispersant |
| SQS | near-IR dye; 4-[3-[2,6-Bix(1,10-dimethylethyl)-4H-thiopyran-4-ylidene]methyl]-2-hydroxy-4-oxo-2-cyclobuten-1-ylidene] |

-continued

EXAMPLES
GLOSSARY:

| | |
|---|---|
| | methyl-2,6-bis(1,1-diethylethyl) thiopyrylium hydroxide, inner salt |
| T-785 | solid epoxy-novolac resin; TACTIX 785 from Dow Chemical Co., Midland, MI |
| TIC-5C | near-IR dye; 3H-Indolium, 2-[2-[2-chloro-3-[2-(1,3-dihydro-2H-indol-2-ylidene) ethylidene]-1-cyclopenten-1-yl] ethenyl]-1,3,3-trimethyl-trifluoromethanesulfonate |

In the examples which follow, "coating solution" refers to the mixture of solvent and additives which is coated on the support. Amounts are expressed in parts by weight, unless otherwise specified.

General Procedure

The components of the coating solution were combined in an amber glass bottle and rolled overnight to ensure complete mixing. (When a pigment was present in the composition, it was first mixed with the dispersant in a solvent on an attritor with steel balls for approximately 20 hours.) The mixed solution was then coated onto a 4 mil (0.010 cm) thick sheet of Mylar ® polyester film (E. I. du Pont de Nemours and Company, Wilmington, Del.). The coating was air dried to form a donor element having a laserable layer having a dry thickness in the range from 0.3 to 2.0 micrometers depending on percent solids of the formulation and the blade used to coat the formulation onto the plate.

The receiver element was placed on the drum of a laser imaging apparatus such that the receiving layer, if present, is facing outward (away from the drum surface). The donor element was then placed on top of the receiver element such that the infrared sensitive layer was adjacent to the receiving side of the receiver element. A vacuum was then applied. Two types of laser imaging apparatuses were used. The first was a Crosfield Magnascan 646 (Crosfield Electronics, Ltd., London, England) which had been retrofitted with a CREO writehead (Creo Corp., Vancouver, BC) using an array of 36 infrared lasers emitting at 830 nm (SDL-7032-102 from Sanyo Semiconductor, Allendale, N.J.). The second type was a Creo Plotter (Creo Corp., Vancouver, BC) having 32 infrared lasers emitting at 830 nm. The laser fluence was calculated based on laser power and drum speed.

TABLE 1

CALCULATED LASER FLUENCE vs. DRUM SPEED
Drum speed/fluence correlation

| Pitch (uM) | r(1/e$^2$) (uM) | Fluence (FWHM) (mJ/cm$^2$) | Drum Velocity (rpm) |
|---|---|---|---|
| 2.9 | 3.9 | 100 | 370 |
| | | 150 | 246 |
| | | 200 | 185 |
| | | 250 | 148 |
| | | 300 | 123 |
| | | 350 | 106 |

When the vacuum was removed the donor element separated from the receiver element.

Example 1

This example illustrates the effect of the MVM on the binder. The binder used was EPT2678; HBVE and DBP were used as MVM.

The components were mixed together at three different MVM:binder ratios. The Brookfield viscosity was measured on a Brookfield Viscometer, model DV-II, at 25° C. The results are given below. The resin without an MVM was a solid and thus the Brookfield viscosity was not measured.

| | Brookfield Viscosity | |
|---|---|---|
| MVM:Resin | HBVE (Spindle #, Speed) | DBP (Spindle #, Speed) |
| 1:1 | 5740 (2, 3) | 782,000 (4, 0.3) |
| 2:1 | 210 (2, 12) | 4,210 (3, 3) |
| 3:1 | 63 (2, 12) | 521 (3, 3) |

It is clear that both MVM compounds lower the viscosity of the binder. In this case, HBVE is more effective at lowering the viscosity.

Example 2

This example illustrates the effect of the MVM on transfer density.

Cyan pigment was the imageable component; DBP or GTB was the MVM; EPT 2678 was the binder. The receiver element was paper. The Creo Plotter was used for imaging.

Coating formulations were prepared as 10 wt % solids in MEK, having the following compositions:

| | Weight % (Dry coating basis) | | | | |
|---|---|---|---|---|---|
| Component | Control | 2A | 2B | 2C | 2D |
| Cyan | 45 | 45 | 45 | 45 | 45 |
| DBP | 0 | 12.5 | 25 | 0 | 0 |
| GTB | 0 | 0 | 0 | 12.5 | 25 |
| E2678 | 50 | 37.5 | 25 | 7.5 | 25 |
| SQS | 5 | 5.0 | 5.0 | 5.0 | 5 |

These formulations were first coated onto Mylar® using a 1.5 μm blade to obtain a low coating weight. A second coating was made for each formulation using a 3.0 μm blade to obtain a high coating weight.

The coated samples were imaged over a range of laser fluences and the reflectance density of the image transferred to paper was measured as null density using the reflectance mode of a MacBeth densitometer. The results for the low coating weight samples are given in Table 2 below and in FIG. 1A. The results for the high coating weight samples are given in Table 3 below and in FIG. 1B.

TABLE 2

| | Low Coating Weights | | | | |
|---|---|---|---|---|---|
| | Density Transferred | | | | |
| Fluence (mJ/cm$^2$) | Control | 2A | 2B | 2C | 2D |
| 100 | 0.00 | 0.00 | 0.00 | 0.00 | 0.00 |
| 175 | 0.00 | 0.28 | 0.48 | 0.24 | 0.14 |
| 250 | 0.19 | 1.08 | 1.12 | 0.90 | 1.08 |
| 325 | 0.89 | 1.18 | 1.20 | 1.09 | 1.18 |
| 400 | 1.14 | 1.19 | 1.21 | 1.14 | 1.24 |
| 475 | 1.19 | 1.23 | 1.13 | 1.11 | 1.22 |

TABLE 3

| | High Coating Weights | | | | |
|---|---|---|---|---|---|
| | Density Transferred | | | | |
| Fluence (mJ/cm$^2$) | Control | 2A | 2B | 2C | 2D |
| 100 | 0.00 | 0.00 | 0.00 | 0.00 | 0.00 |
| 175 | 0.00 | 0.00 | 0.03 | 0.00 | 0.08 |
| 250 | 0.00 | 0.29 | 1.06 | 0.53 | 1.24 |
| 325 | 0.01 | 0.96 | 1.18 | 0.93 | 1.29 |
| 400 | 0.15 | 1.20 | 1.30 | 1.20 | 1.34 |
| 475 | 0.77 | 1.32 | 1.29 | 1.34 | 1.40 |

It is clear from the tables and graphs that transferred pigment density is greater when the MVM is present except at the highest fluence levels. In the absence of the MVM, transferred pigment density actually decreases as the coating weight is increased.

Example 3

This example illustrates the effect of the MVM in a lithographic application.

DER 665 functioned as the oleophilic material; DVE and CHVE were the MVM. DEH 82 was present for a post-transfer curing step. The receiver element was a sheet of anodized aluminum, Imperial type DE (Imperial Metal and Chemical Co., Philadelphia, Pa.). The Crosfield apparatus was used for imaging with a fluence level of about 800 mJ/cm$^2$.

Coating formulations were prepared as 15 wt % solids in MEK, having the following compositions:

| | Weight % (dry coating basis) | |
|---|---|---|
| Component | Control | Sample 3 |
| DEH 82 | 3.5 | 3.5 |
| DVE | 0 | 23.5 |
| CHVE | 0 | 23.5 |
| TIC-5C | 3.5 | 3.5 |
| DER 665U | 93.0 | 46.0 |

With the control, little or no transfer to the surface of the aluminum plate was observed. Good transfer was observed with Sample 3, visible as a greenish image, colored by the presence of the near-IR dye, TIC-5C. The thickness of the image on the aluminum receiver element was measured using a DEKTAK profilometer and found to be approximately 1.5 to 2.0 micrometers.

Example 4

This example illustrates the ability to use lower levels of the laser-absorbing component when an MVM is present.

A pigment was the imageable component; GTB was the MVM, E2010 and EPT2445 were binders.

The receiver element was paper. The Creo Plotter was used for imaging.

Coating formulations were prepared as 10 wt % solids in MEK, having the following compositions:

| | Component | | | | |
|---|---|---|---|---|---|
| Sample | Cyan | E2010 | EPT2445 | GTB | SOS |
| Controls (no MVM) | | | | | |
| C4-A | 75 | 15.9 | 0 | 0 | 9.1 |
| C4-B | 78.6 | 16.7 | 0 | 0 | 4.8 |
| C4-C | 79.5 | 16.9 | 0 | 0 | 3.6 |
| C4-D | 80.5 | 17.1 | 0 | 0 | 2.4 |
| C4-E | 81.5 | 17.3 | 0 | 0 | 1.2 |
| C4-F | 82.5 | 17.5 | 0 | 0 | 0 |

-continued

| Sample | Component | | | | |
|---|---|---|---|---|---|
| | Cyan | E2010 | EPT2445 | GTB | SOS |
| With MVM | | | | | |
| 4-A | 27.3 | 0 | 22.7 | 40.9 | 9.1 |
| 4-B | 28.6 | 0 | 23.8 | 42.9 | 4.8 |
| 4-C | 28.9 | 0 | 24.1 | 43.4 | 3.6 |
| 4-D | 29.3 | 0 | 24.4 | 43.9 | 2.4 |
| 4-E | 29.6 | 0 | 24.7 | 44.4 | 1.2 |
| 4-F | 30 | 0 | 25 | 45 | 0 |

The samples were imaged at three different fluence levels. The density transferred was measured as described above. The results are given in Table 4.

TABLE 4

| Sample | Density Transferred | | |
|---|---|---|---|
| | 308 | 231 | 184 mJ/cm$^2$ |
| No MVM | | | |
| C4-A | 0.84 | 0.64 | 0.34 |
| C4-B | 0.57 | 0.40 | 0.17 |
| C4-C | 0.53 | 0.28 | 0.15 |
| C4-D | 0.30 | 0.13 | 0.04 |
| C4-E | 0.03 | 0.00 | 0.00 |
| C4-F | 0.00 | 0.00 | 0.00 |
| With MVM | | | |
| 4-A | 0.83 | 0.97 | 0.85 |
| 4-B | 0.90 | 0.93 | 0.75 |
| 4-C | 0.85 | 0.95 | 0.68 |
| 4-D | 0.86 | 0.80 | 0.35 |
| 4-E | 0.72 | 0.33 | 0.11 |
| 4-F | 0.00 | 0.00 | 0.00 |

From these results it can be seen that (1) the melt process of the invention in which the MVM is present is much less sensitive to energy (laser fluence); (2) the melt process of the invention in which the MVM is present needs less laser absorbing component; and (3) the pigment loading to achieve equivalent densities is much lower when the MVM is present. This can result in greater formulation latitude which can be important in achieving SWOP densities. It also allows for the use of lower concentrations of laser absorbing components which can add unwanted color in proofing applications.

Example 5

This example illustrates several different formulations for proofing applications.

The coatings were prepared at low and high coating weights as described in Example 2. Cyan pigment was the imageable component; BGE, DVE, CHVE and HBVE were used as the MVM; EPT2678 was the binder.

Coating formulations were prepared at 11 wt % solids in MEK, having the following compositions:

| Component | Weight % (Dry Coating Basis) | | | | | | | | |
|---|---|---|---|---|---|---|---|---|---|
| | Control | 5A | 5B | 5C | 5D | 5E | 5F | 5G | 5H |
| Cyan | 45.0 | 45.0 | 45.0 | 45.0 | 45.0 | 45.0 | 45.0 | 45.0 | 45.0 |
| EPT2678 | 50.0 | 37.5 | 37.5 | 37.5 | 37.5 | 25.0 | 25.0 | 25.0 | 25.0 |
| SQS | 5.0 | 5.0 | 5.0 | 5.0 | 5.0 | 5.0 | 5.0 | 5.0 | 5.0 |
| BGE | — | 12.5 | — | — | — | 25.0 | — | — | — |
| DVE | — | — | 12.5 | — | — | — | 25.0 | — | — |
| CHVE | — | — | — | 12.5 | — | — | — | 25.0 | — |
| HBVE | — | — | — | — | 12.5 | — | — | — | 25.0 |

The coated samples were imaged using different laser fluences and the reflectance densities measures as described in Example 2. The results for the low coating weights are given in Table 5 below. The results for the high coating weight samples are given in Table 6 below.

TABLE 5

| Fluence (mJ/cm$^2$) | Low Coating Weights Density Transferred | | | | | | | | |
|---|---|---|---|---|---|---|---|---|---|
| | Control | 5A | 5B | 5C | 5D | 5E | 5F | 5G | 5H |
| 100 | 0.00 | 0.00 | 0.00 | 0.00 | 0.00 | 0.00 | 0.00 | 0.00 | 0.00 |
| 175 | 0.00 | 0.07 | 0.39 | 0.12 | 0.09 | 0.23 | 1.04 | 0.27 | 0.19 |
| 250 | 0.19 | 0.75 | 1.01 | 0.82 | 0.85 | 0.84 | 1.20 | 0.83 | 0.80 |
| 325 | 0.89 | 1.00 | 1.08 | 1.02 | 1.04 | 1.05 | 1.20 | 1.03 | 1.02 |
| 400 | 1.14 | 1.08 | 1.13 | 1.16 | 1.11 | 1.12 | 1.18 | 1.08 | 1.10 |
| 475 | 1.19 | 1.06 | 1.15 | 1.16 | 1.17 | 1.12 | 1.16 | 1.10 | 1.03 |

TABLE 6

| Fluence (mJ/cm$^2$) | High Coating Weights Density Transferred | | | | | | | | |
|---|---|---|---|---|---|---|---|---|---|
| | Control | 5A | 5B | 5C | 5D | 5E | 5F | 5G | 5H |
| 100 | 0.00 | 0.00 | 0.00 | 0.00 | 0.00 | 0.00 | 0.00 | 0.00 | 0.00 |
| 175 | 0.00 | 0.00 | 0.00 | 0.00 | 0.00 | 0.00 | 0.25 | 0.00 | 0.00 |
| 250 | 0.00 | 0.02 | 0.75 | 0.17 | 0.13 | 0.07 | 1.22 | 0.90 | 0.04 |
| 325 | 0.01 | 0.25 | 1.14 | 0.95 | 0.90 | 0.80 | 1.20 | 1.00 | 0.86 |
| 400 | 0.15 | 0.77 | 1.25 | 1.16 | 1.09 | 1.05 | 1.26 | 1.27 | 1.14 |
| 475 | 0.77 | 1.03 | 1.31 | 1.27 | 1.19 | 1.17 | 1.25 | 1.28 | 1.17 |

From this data it appears that the best performance is obtained using the higher level of DVE as the MVM (sample 5B) at the lower coating weight. High pigment density is transferred at a relatively low fluence.

What is claimed is:

1. A laser-induced melt transfer method for making a color image which consists essentially of:

a) imagewise exposing to laser radiation a laserable assemblage comprising 1) a donor element consisting essentially of a support bearing on a first surface thereof a composition selected from the group consisting of:

(A)(i) at least one colorant and (ii) at least one melt viscosity modifier to lower melt viscosity, (B)(i) at least one colorant, (ii) at least one melt viscosity modifier to lower melt viscosity, and (iii) a binder, (C)(i) at least one colorant, (ii) at least one melt viscosity modifier to lower melt viscosity, and (iv) a laser radiation absorbing component, and (D)(i)at least one colorant, (ii) at least one melt viscosity modifier to lower melt viscosity, (iii) a binder and (iv) a laser radiation absorbing component, wherein (i) and (ii) can be in the same or different layers, and 2) a receiver element situated proximally to the first surface of the donor element, wherein a substantial portion of (i) and (ii) is transferred to the receiver element;

b) separating the donor element from the receiver element, steps (a)-(b) being repeated at least once using the same receptor and a different donor element having a colorant the same as or different from the first colorant.

2. A process according to claim 1 wherein the receiver element is paper.

3. A process according to claim 1 wherein the laser radiation is in the IR, near-IR, or visible region.

* * * * *